US011545059B2

(12) United States Patent
Chuang

(10) Patent No.: US 11,545,059 B2
(45) Date of Patent: Jan. 3, 2023

(54) DISPLAY DEVICE AND METHOD TO BLUR BORDERLINE IN CUD DEVICE

(71) Applicant: HIMAX TECHNOLOGIES LIMITED, Tainan (TW)

(72) Inventor: Chi-Feng Chuang, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 17/209,127

(22) Filed: Mar. 22, 2021

(65) Prior Publication Data

US 2022/0301472 A1 Sep. 22, 2022

(51) Int. Cl.
*G09G 3/00* (2006.01)

(52) U.S. Cl.
CPC ..... *G09G 3/007* (2013.01); *G09G 2320/029* (2013.01); *G09G 2320/0271* (2013.01); *G09G 2320/0686* (2013.01)

(58) Field of Classification Search
CPC ..... G09G 3/007; G09G 2320/0271; G09G 2320/029; G09G 2320/0686; G09G 3/2003; G09G 3/3233; H01L 27/3216; H01L 27/14601; H01L 27/32763; G03B 11/00; G02B 6/0055; H04N 5/247
See application file for complete search history.

(56) References Cited

U.S. PATENT DOCUMENTS

| | | | | |
|---|---|---|---|---|
| 10,768,356 | B1 * | 9/2020 | Zhang | G02B 6/0055 |
| 2006/0280249 | A1 | 12/2006 | Poon | |
| 2020/0234634 | A1 * | 7/2020 | Li | G09G 3/3233 |
| 2021/0065606 | A1 * | 3/2021 | Park | G09G 3/2003 |
| 2021/0065625 | A1 * | 3/2021 | Wang | G09G 3/3266 |
| 2021/0124141 | A1 * | 4/2021 | Sun | H04N 5/247 |
| 2021/0136282 | A1 * | 5/2021 | Wu | H01L 27/14601 |
| 2021/0143364 | A1 * | 5/2021 | Jin | H01L 27/3276 |
| 2021/0202617 | A1 * | 7/2021 | Cho | H01L 27/3216 |
| 2021/0210533 | A1 * | 7/2021 | Cho | G03B 11/00 |
| 2021/0335187 | A1 * | 10/2021 | Hong | G09G 3/2003 |
| 2022/0262294 | A1 * | 8/2022 | Hong | G09G 3/2003 |

FOREIGN PATENT DOCUMENTS

| | | |
|---|---|---|
| CN | 1913585 A | 2/2007 |
| CN | 101809647 B | 6/2013 |
| TW | 200501035 | 1/2005 |
| TW | 200923889 | 6/2009 |

* cited by examiner

*Primary Examiner* — Richard J Hong
(74) *Attorney, Agent, or Firm* — Winston Hsu

(57) ABSTRACT

A display device includes a sensor pixel set having a maximal sensor pixel brightness value SV, a display pixel set having a display pixel brightness value DV, and a blurring pixel set disposed between the sensor pixel set and the display pixel set and having a blurring pixel brightness value BV. A minimal distance between the blurring pixel set and the sensor pixel set is Z and a minimal distance between the blurring pixel set and the display pixel set is (1−Z) to satisfy: BV=(1−Z)*SV+Z*DV.

19 Claims, 8 Drawing Sheets
(2 of 8 Drawing Sheet(s) Filed in Color)

DISPLAY DEVICE AND METHOD TO BLUR BORDERLINE IN CUD DEVICE

BACKGROUND OF THE INVENTION

1. Field of the Invention

The present invention generally relates to a display device and to a method to blur a borderline in a CUD (camera under display) device. In particular, the present invention is directed to a method to blur a sharp borderline between a sensor region and a display region in a display device in terms of the adjustment of a gamma level of pixel units for use in a CUD device.

2. Description of the Prior Art

For better display quality, a mobile phone may be advantageously designed to hide a camera under the display panel. However, some incident light toward camera may be blocked by the pixels, and a transparent material of OLED is still too expensive to be applied in general products.

To cope with the problem, an incomplete sub-pixel layout may be proposed to hide the camera under the panel. Further, in the panel some pixels in CUD area are cut off to facilitate the proper functions of the camera.

As shown in FIG. 1, this incomplete sub-pixel layout may result in a contour issue occurring on a borderline 11 of the CUD region 10 and of a normal region 20. The contour issue in FIG. 1 shows a sharp visual difference, i.e. the borderline 11, between the CUD region 10 and the normal region 20 to jeopardize the visual display quality of the panel 1 in the presence of the CUD region 10.

SUMMARY OF THE INVENTION

Given the above, the present invention in a first aspect proposes a novel display device to improve the visual display quality of a CUD device in the presence of a CUD region, for example to minimize the visual presence of the CUD region. With the visual absence of the CUD region, the borderline is blurred to hide the CUD region. The present invention in a second aspect proposes a novel method to blur a borderline in a CUD device to improve the visual display quality of the CUD device in the presence of a CUD region.

The present invention in a first aspect proposes a novel display device. The display device includes a display panel, an image sensor, a sensor pixel set, a display pixel set and a blurring pixel set. The display panel includes a display region, a blurring region enclosed by the display region and a sensor region enclosed by the blurring region. The image sensor is disposed in the sensor region. The sensor pixel set is disposed in the sensor region, next to the blurring region and has a maximal sensor pixel brightness value SV. The display pixel set is disposed in the display region, next to the blurring region and has a display pixel brightness value DV. The blurring pixel set is disposed in the blurring region, located between the sensor pixel set and the display pixel set and has a blurring pixel brightness value BV. A minimal distance between the display pixel set and the sensor pixel set is 1, a minimal distance between the blurring pixel set and the sensor pixel set is Z and a minimal distance between the blurring pixel set and the display pixel set is (1−Z) so that BV=(1−Z)*SV+Z*DV.

In one embodiment of the present invention, the sensor pixel set includes n active sensor pixels and m inactive sensor pixels.

In another embodiment of the present invention, the display pixel set includes n+m active display pixels and is free of an inactive display pixel.

In another embodiment of the present invention, each one of the active display pixels has the display pixel brightness value DV so that DV=[n/(n+m)]*100.

In another embodiment of the present invention, the blurring region is in a form of a hollow circle and includes an inner concentric circle and an outer concentric circle. The inner concentric circle has a center of the inner concentric circle.

In another embodiment of the present invention, a straight line passes through the center of the inner concentric circle, the sensor pixel set, the blurring pixel set and the display pixel set.

In another embodiment of the present invention, the display device further includes at least one pin hole disposed in the sensor region.

In another embodiment of the present invention, the at least one pin hole represents the m inactive sensor pixels.

In another embodiment of the present invention, the blurring pixel brightness value BV represents a gamma level of a blurring pixel in the blurring pixel set.

The present invention in a second aspect proposes a novel method to blur a borderline in a CUD device. First, a CUD device is provided. The CUD device includes a display region, a blurring region enclosed by the display region and a sensor region enclosed by the blurring region. A sensor pixel set is disposed in the sensor region, next to the blurring region and has a maximal sensor pixel brightness value SV. The sensor pixel set includes n active sensor pixels and m inactive sensor pixels. A display pixel set is disposed in the display region, next to the blurring region and has a display pixel brightness value DV. The display pixel set includes n+m active display pixels and is free of an inactive display pixel. A blurring pixel set is disposed in the blurring region, located between the sensor pixel set and the display pixel set, and has a blurring pixel brightness value BV. Second, the display pixel brightness value DV in accordance with DV=[n/(n+m)]*100 is determined. Then, the blurring pixel brightness value BV in accordance with BV=(1−Z)*SV+Z*DV is determined after the display pixel brightness value DV is determined. A minimal distance between the display pixel set and the sensor pixel set is 1, a minimal distance between the blurring pixel set and the sensor pixel set is Z, and a minimal distance between the blurring pixel set and the display pixel set is (1−Z).

In one embodiment of the present invention, the blurring region is in a form of a hollow circle and includes an inner concentric circle and an outer concentric circle. The inner concentric circle has a center of the inner concentric circle.

In another embodiment of the present invention, the blurring pixel brightness value BV is determined to blur the borderline of the inner concentric circle.

In another embodiment of the present invention, a straight line passes through the center of the inner concentric circle, the sensor pixel set, the blurring pixel set and the display pixel set.

In another embodiment of the present invention, the blurring pixel brightness value BV represents a gamma level of a blurring pixel in the blurring pixel set.

In another embodiment of the present invention, the sensor pixel set includes a first sensor pixel having the maximal sensor pixel brightness value SV and a second sensor pixel having a minimal sensor pixel brightness value 0.

In another embodiment of the present invention, the blurring pixel set includes a first blurring pixel having a first blurring pixel brightness value BV1 and a second blurring pixel having a second blurring pixel brightness value BV2.

In another embodiment of the present invention, the first blurring pixel brightness value BV1 is different from the second blurring pixel brightness value BV2.

In another embodiment of the present invention, the first blurring pixel brightness value BV1 and the second blurring pixel brightness value BV2 respectively represent a gamma level.

In another embodiment of the present invention, the first sensor pixel corresponds to the first blurring pixel and the second sensor pixel corresponds to the second blurring pixel In another embodiment of the present invention, total brightness of the display pixel set equals to total brightness of the blurring pixel set.

In another embodiment of the present invention, total brightness of the sensor pixel set equals to the total brightness of the blurring pixel set.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 2:
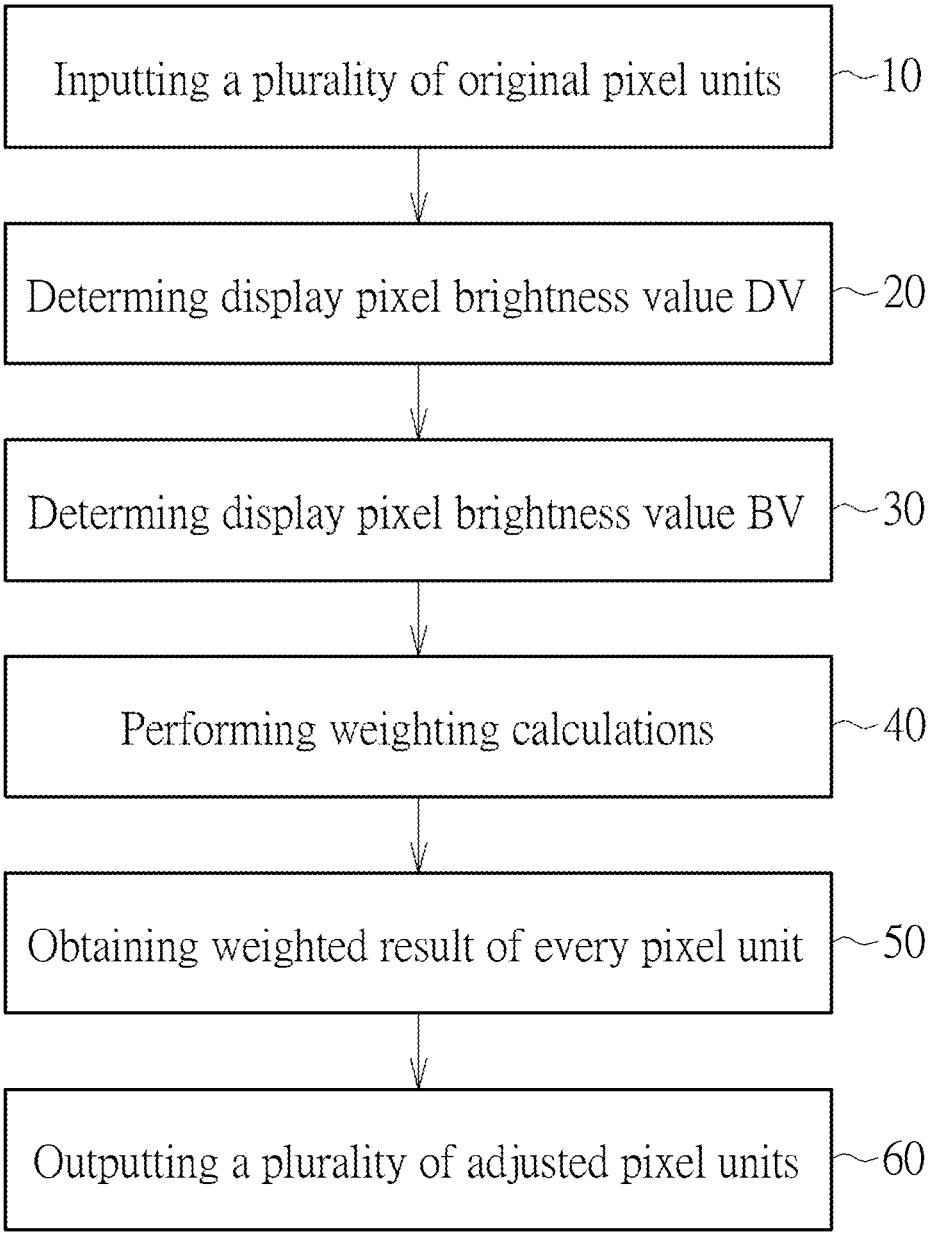
FIG. 2 is an example of the flow chart of the method to blur a borderline in a CUD device of the present invention.
Figure 3:
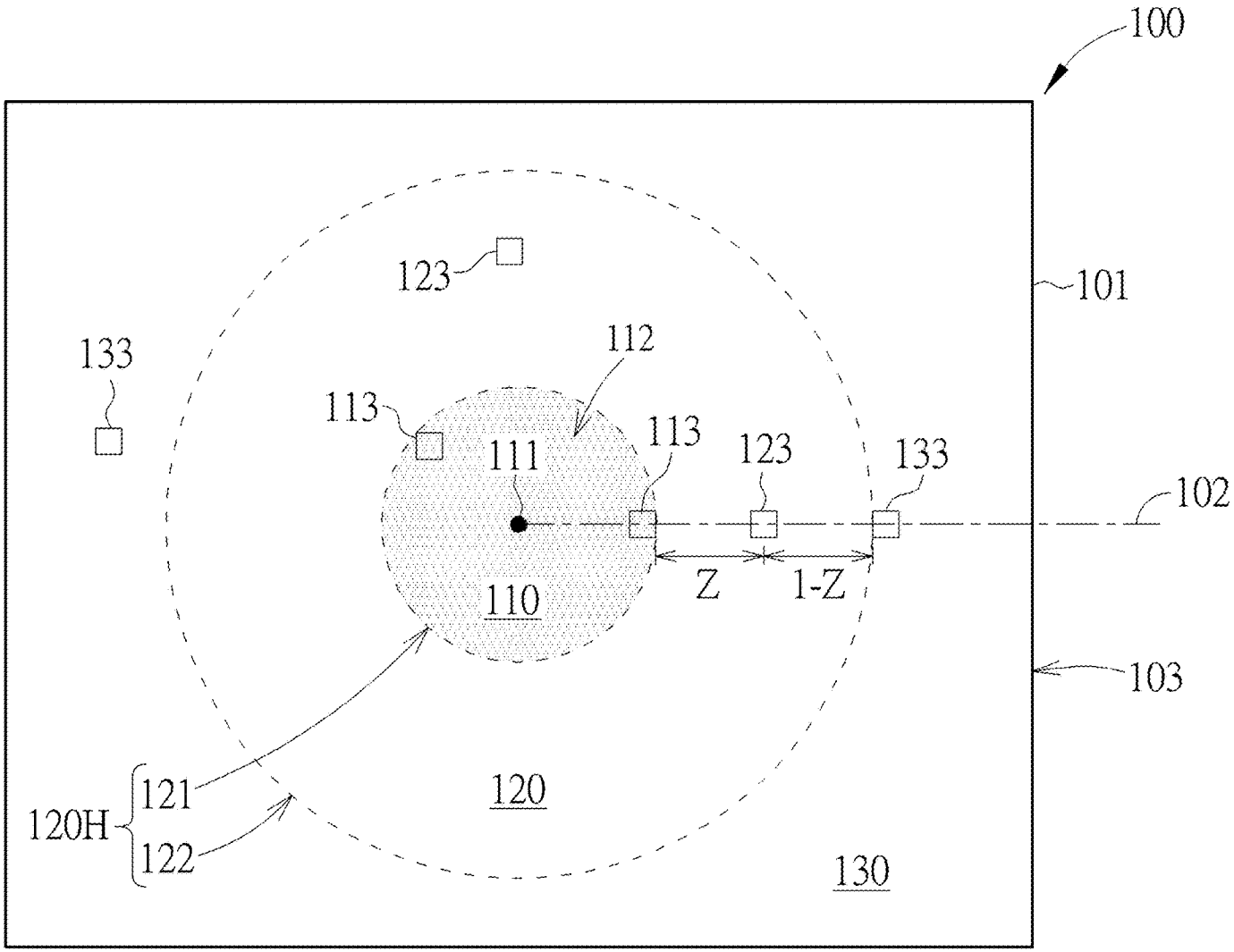
FIG. 3 illustrates a top view of a CUD device in accordance with an example of the present invention.
Figure 4:
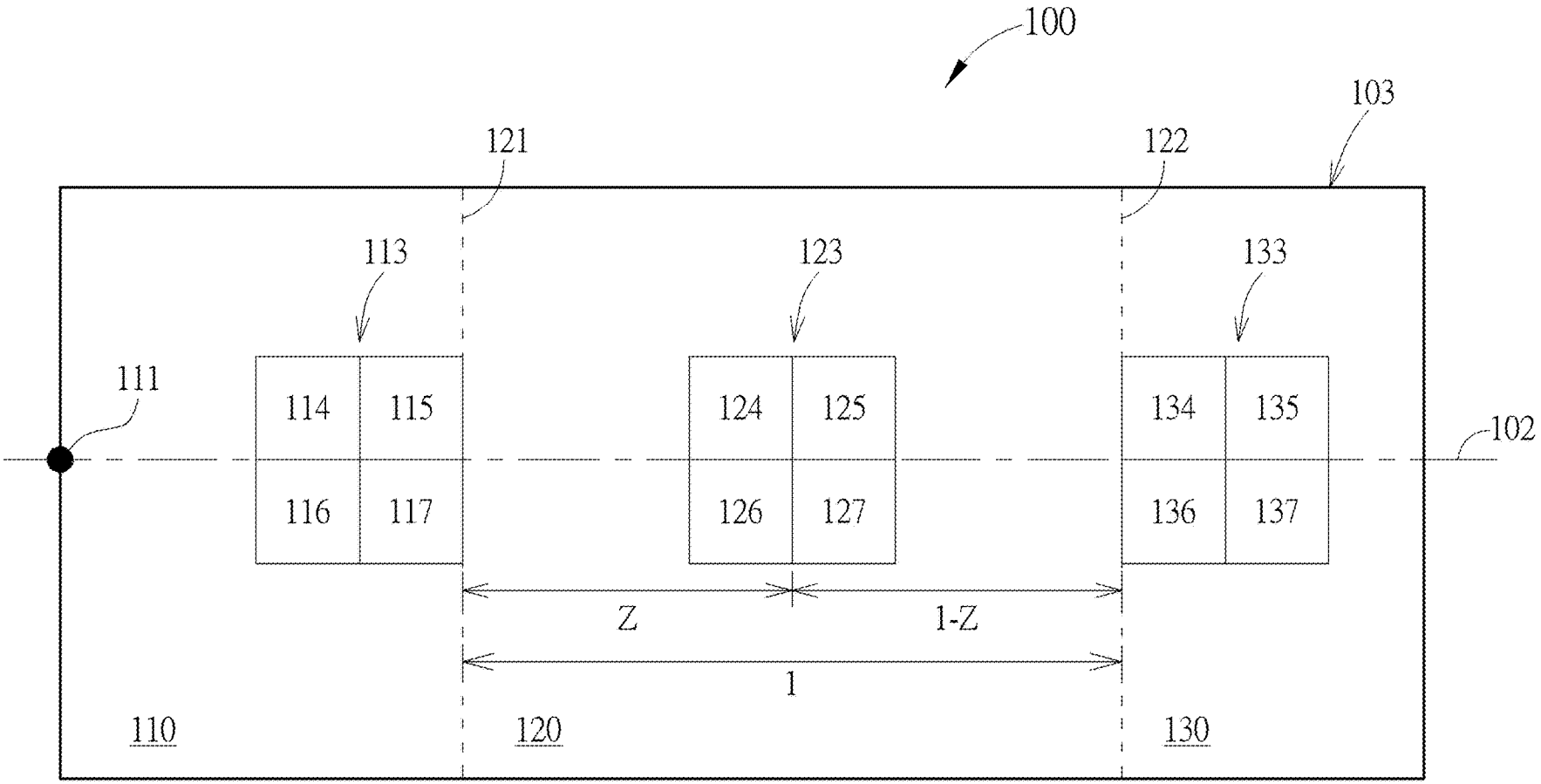
FIG. 4 illustrates a partial enlarged view of the CUD device along a straight line in accordance with FIG. 3 of the present invention.

To improve the display quality, the present invention provides an adjusting method to blur a borderline in a CUD device in the presence of a CUD region, for example to minimize or further to eliminate the undesirable visual presence of the CUD region. FIG. 2 is an example of the flow chart of the method to blur a borderline in a CUD device of the present invention. FIG. 3 to FIG. 4 illustrates an example of operational procedures for blurring a borderline in a CUD device of the present invention.

Please refer to FIG. 2, the step 10 is carried out. The step 10 refers to input a plurality of original pixel units. The original pixel units may be pixels or sub-pixels of a display device. The display device may correspond to a CUD device 100 shown in FIG. 3. For example, there are a plurality of pixel units in the CUD device 100. A pixel unit may be a pixel or a sub-pixel to have a predetermined color and brightness. A pixel may include a plurality of sub-pixels, and each sub-pixel may illuminate light of a color, for example a red color (referred to as R), a green color (referred to as G), a blue color (referred to as B) or another suitable color, but the present invention is not limited thereto. In other words, the step 10 may be referred to as inputting R/G/B information.

Figure 1:
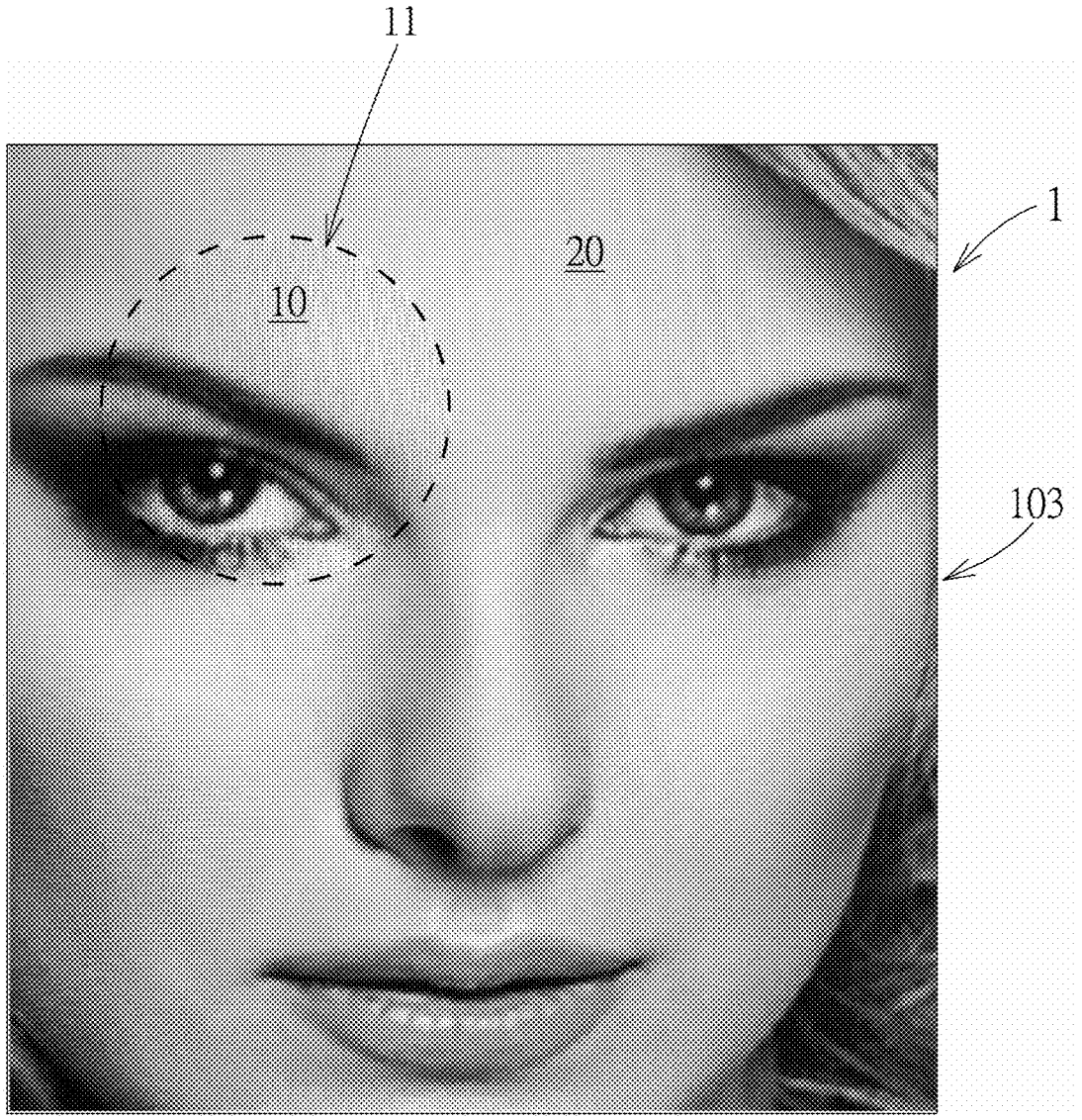
FIG. 1 shows an example of a contour issue occurring on the borderline of a CUD region and a normal region to exhibit a sharp visual difference between the CUD region and the normal region to jeopardize the visual display quality of a panel in the presence of the CUD region.

Please refer to FIG. 3. FIG. 3 illustrates a top view of a CUD device in accordance with an example of the present invention. The CUD device 100 is provided. The CUD device 100 may include a display panel 101 for displaying a pictures or images, such as the image 103 as shown in FIG. 1. The CUD device 100 may further include other suitable elements, such as an input unit (not shown), an output unit (not shown) or a control unit (not shown), but the present invention is not limited thereto. The display panel 101 may include a plurality of functional regions, for example a sensor region 110, a blurring region 120 and a display region 130, but the present invention is not limited thereto. In some embodiment of the present invention, the sensor region 110 may be enclosed by the blurring region 120, and the blurring region 120 may be enclosed by the display region 130. In some embodiment of the present invention, the blurring region 120 may be in a form of a hollow circle 120H. The hollow circle 120H may include an inner concentric circle 121 and an outer concentric circle 122. The inner concentric circle 121 may have a center 111 of the inner concentric circle 121 so the center 111 may be the center of the outer concentric circle 122, too.

The display panel 101 may include an image sensor 112 disposed in the sensor region 110. The image sensor 112 may be at least partially disposed in the sensor region 110 or completely disposed in the sensor region 110. The image sensor 112 may be used as a camera in the CUD device 100.

As described above, there are a plurality of pixels or sub-pixels in the display device 100. Different pixels or different sub-pixels in different regions of the display device 100 may form different pixel sets. In some embodiment of the present invention, at least one sensor pixel set 113 may be disposed in the sensor region 110 next to the blurring region 120. In other words, the sensor pixel set 113 may be disposed at the inner concentric circle 121, i.e. a borderline between the sensor region 110 and the blurring region 120. The sensor pixel set 113 may include one or more sensor pixel units. FIG. 4 illustrates that a sensor pixel set 113 may include a plurality of sensor sub-pixels, but the present invention is not limited thereto.

In some embodiment of the present invention, at least one blurring pixel set 123 may be disposed in the blurring region 120. In other words, the blurring pixel set 123 may be disposed between the inner concentric circle 121 and the outer concentric circle 122, i.e. between the sensor region 110 and the display region 130. The blurring pixel set 123 may include one or more blurring pixel units. FIG. 4 illustrates that a blurring pixel set 123 may include a plurality of sensor sub-pixels, but the present invention is not limited thereto.

In some embodiment of the present invention, at least one display pixel set 133 may be disposed in the display region 130 next to the blurring region 120. For example, the display pixel set 133 may be disposed at the outer concentric circle 122, i.e. a borderline between the display region 130 and the blurring region 120. The display pixel set 133 may include one or more display pixel units. FIG. 4 illustrates that a display pixel set 133 may include a plurality of display sub-pixels, but the present invention is not limited thereto.

In some embodiment of the present invention, there may be a straight line 102 passing through the sensor pixel set 113, the blurring pixel set 123 and the display pixel set 133. In some embodiment of the present invention, the straight line 102 may further pass through the center 111 of the inner concentric circle 121, the sensor pixel set 113, the blurring pixel set 123 and the display pixel set 133 so that a blurring pixel set 123 may be disposed right between a sensor pixel set 113 and a display pixel set 133. The blurring pixel set 123 may include one or more blurring pixel units. In some embodiment of the present invention, FIG. 4 illustrates that a minimal distance between the display pixel set 133 and the sensor pixel set 113 is 1, a minimal distance between the blurring pixel set 123 and the sensor pixel set 113 is Z, and a minimal distance between the blurring pixel set 123 and the display pixel set 133 is (1−Z).

FIG. 4 illustrates a partial enlarged view of the CUD device 100 along the straight line 102 in accordance with FIG. 3 of the present invention. The sensor pixel set 113 may include one or more sensor pixel units to form a unit cell. In one embodiment of the present invention, the active sensor pixels and the inactive sensor pixels in the sensor region 110 may collectively form a pattern or may be regularly arranged. A unit cell which includes the active sensor pixels and the inactive sensor pixels to represent the minimal repeating unit of the pattern or the arrangement is shown by one of the sensor pixel sets 113. For example, a sensor pixel set 113 may include n active sensor pixels and m inactive sensor pixels, wherein n is an integer not less than 1 and m is an integer not less than 1. In another embodiment of the present invention, FIG. 4 illustrates the sensor pixel set 113 may include four sensor sub-pixels, i.e. n+m=4, but the present invention is not limited thereto. For example, the sensor pixel set 113 may include a sensor sub-pixel 114, a sensor sub-pixel 115, a sensor sub-pixel 116 and a sensor sub-pixel 117, regardless the colors of the four sensor sub-pixels.

Similarly, the blurring pixel set 123 may include one or more blurring pixel units to form a unit cell. The quantity of blurring pixel units in a unit cell is the same as that of the sensor pixel units in a unit cell. For example FIG. 4 illustrates the blurring pixel set 123 may include four blurring sub-pixels to correspond to the four sensor sub-pixels in the sensor pixel set 113, regardless the colors of the sensor sub-pixels. For example, the blurring pixel set 123 may include a blurring sub-pixel 124, a blurring sub-pixel 125, a blurring sub-pixel 126, and a blurring sub-pixel 127, but the present invention is not limited thereto.

Similarly, the display pixel set 133 may include one or more display pixel units to form a unit cell. The quantity of blurring pixel units in a unit cell is the same as that of display pixel units in a unit cell. For example FIG. 4 illustrates the display pixel set 133 may include four display sub-pixels to correspond to the four sensor sub-pixels in the sensor pixel set 113, regardless the colors of the sensor sub-pixels. For example, the display pixel set 133 may include a display sub-pixel 134, a display sub-pixel 135, a display sub-pixel 136 and a display sub-pixel 137, but the present invention is not limited thereto.

As described above, there is an image sensor 112 disposed in the sensor region 110 and a pixel unit which is occupied by a portion of the image sensor 112 may become a pin hole (represented by a dot) to allow incident light to reach the image sensor 112 to form a portion of an image. Due to the presence of one or more pin holes (i.e. one or more dots as shown in FIG. 1 of the CUD region 10), one or more of the sensor pixel units in the sensor region 110 become inactive sensor pixel units because these inactive sensor pixel units which correspond to dots are not capable of emitting light any more. FIG. 1 shows the pinholes which correspond to inactive sensor pixel units in the form of a visually dotted region which corresponds to the sensor region 110.

Accordingly, the sensor region 110 which includes the image sensor 112 may visually shows some active sensor pixels and some inactive sensor pixels. An active sensor pixel may refer to a sensor pixel unit which is capable of emitting light of any suitable color. An inactive sensor pixel may refer to a sensor pixel unit which is not capable of emitting light at all. For example, an inactive sensor pixel may refer to a pixel unit which is occupied by a pin hole which is represented by the image sensor 112 in the sensor region 110 to de-active the functions of the sensor pixel unit. A collection of the inactive sensor pixels in the sensor region 110 may adversely change the predetermined visual presentation of a given image as shown in FIG. 1.

Because an inactive sensor pixels has no brightness (no illumination available), the presence of the inactive sensor pixels in a sensor pixel set 113 may inevitably decrease the total brightness of a sensor pixel set 113, i.e. of a unit cell. The more the inactive sensor pixels are present, the less the total brightness of a sensor pixel set 113 has.

To balance the reduction of illumination due to the presence of the inactive sensor pixels, all active sensor pixels in the sensor pixel set 113 may have a maximal sensor pixel brightness value SV and all inactive sensor pixels in the sensor pixel set 113 may have a minimal sensor pixel brightness value 0. A maximal pixel brightness value may refer to a maximal grayscale 255 equivalent to intensity 100%. A minimal pixel brightness value may refer to a minimal grayscale 0 equivalent to intensity 0%. A grayscale or the intensity is well known in the art so the details are not elaborated. In other words, the brightness value of a sensor pixel unit may be either SV or 0 so SV may be equal to the brightness value 100.

The present invention therefore provides the following procedures to mitigate, or to further eliminate the adverse visual interference of the inactive sensor pixels in the sensor region 110. First, as shown in FIG. 2, the step 20 is carried out. The display pixel brightness value DV is determined. The display pixel brightness value DV is preferably related to the sensor pixel brightness value SV.

Due to the presence of the one or more pin holes, not every sensor pixel unit in the sensor region 110 is an active sensor pixel. On the contrary, the display pixel set 133 is disposed in the display region 130 which is a normal display region so every display pixel unit in the display region 130 is an active display pixel which is capable of emitting light of any suitable color in the absence of an inactive display pixel. In some embodiment of the present invention, a display pixel set 133 may similarly and correspondingly include n+m active display pixels and be free of an inactive display pixel if a sensor pixel set 113 includes n active sensor pixels and m inactive sensor pixels.

To exhibit visual uniformity, the visual brightness of a display pixel set 133 is preferably close to or the same as that of a sensor pixel set 113 for the determination of the display pixel brightness value DV. For example, the display pixel brightness value DV may be proportionally decreased relative to the sensor pixel brightness value SV. The sensor pixel brightness value SV may represent a CUD result.

If the sensor pixel set 113 includes n active sensor pixels and m inactive sensor pixels, the display pixel brightness value DV of a display pixel unit may be determined in accordance with DV=[n/(n+m)]*(maximal pixel brightness value SV), for example DV=[n/(n+m)]*100 if SV is set to be 100. A display pixel brightness value DV which satisfies the above relationship in the display region 130 may ensure the visual brightness uniformity relative to that of the sensor region 110. After the above step, the illumination, for example the brightness of the display pixel units in the display region 130 may be uniformed and normalized so they may share the same display pixel brightness value DV to have a uniform visual display quality in the display region 130. Accordingly, the display pixel brightness value DV may represent a normal result or a normalized result.

Second, as shown in FIG. 2, the step 30 is carried out after the step 20 is carried out. A blurring pixel brightness value BV of a blurring pixel unit is determined after the display pixel brightness value DV of a display pixel unit is determined. The determination of the blurring pixel brightness value BV may be a luminance alignment of the blurring pixel brightness value BV from the maximal sensor pixel brightness value SV to the display pixel brightness value DV. This is an adjusting operation for the brightness alignment of the blurring region 120 with respect to the sensor region 110 and to the display region 130.

Differently, to balance the pixel unit brightness between the sensor region 110 and the display region 130, the illumination, for example the brightness of each blurring pixel unit in the blurring region 120 may have a specific blurring pixel brightness value BV in accordance with the display pixel brightness value DV and with the sensor pixel brightness value SV. For instance, a blurring pixel brightness value BV is not greater than the maximal sensor pixel brightness value SV, and not smaller than a corresponding display pixel brightness value DV to form a smooth brightness gradient form SV to DV. Consequently, a pixel unit brightness gradient may be formed along the straight line 102 so that the adverse visual presentation of a given image caused by the inactive display pixels in the sensor region 110 may be gradually weaken and converged to the display region 130 via the blurring region 120. In other words, the pixel unit brightness gradient may be used to blur an obvious borderline 11 of a CUD region as shown in FIG. 1 so that the original borderline may become less visually obvious or further substantially invisible.

A blurring pixel set 123 which forms a unit cell is disposed in the blurring region 120, and located between the sensor pixel set 113 and the display pixel set 133, for example located right between the sensor pixel set 113 and the display pixel set 133. Each pixel unit in the blurring pixel set 123 has an individual blurring pixel brightness value BV. An individual blurring pixel brightness value BV is calculated to align with an SV and with a DV. The individual blurring pixel brightness value BV is determined to blur the borderline of the inner concentric circle 121. A unit cell may include n+m sub-pixels, regardless the colors of sub-pixels, and the n+m sub-pixels may be arranged to form a pattern or arranged in order, for example of locus.

For example, a unit cell in a sensor pixel set 113 may include n active sensor pixels and m inactive sensor pixels, wherein n is an integer not less than 1 and m is an integer not less than 1 so a unit cell may correspondingly include n+m blurring pixels in the blurring pixel set 123 and may correspondingly include n+m display pixels in the display region 130. Some blurring pixel in a unit cell may exclusively correspond to a specific sensor pixel and to a specific display pixel. For example, the first blurring pixel of locus in a unit cell may correspond to the first sensor pixel of locus in another unit cell and to the first display pixel of locus in another unit cell along the straight line 102, and the second blurring pixel of locus in a unit cell may correspond to the second sensor pixel of locus in another unit cell and to the second display pixel of locus in another unit cell along the straight line 102 and so on.

Then, as shown in FIG. 2, the step 40 is carried out after the step 30 is carried out. The step 40 may be an adjusting calculation, such as one or more weighting calculations are carried out. The weighting calculations may involve one or more weighting factors. One or more weighting factors may involve a dimensional measurement, such as a distance, so that the brightness of a sub-pixel in the blurring region 120 may be adjusted in accordance with the distance to a reference point, but the present invention is not limited thereto.

For example, a specific blurring pixel brightness value BV may be determined to satisfy a linear weighting calculation: BV=(1−Z)*SV+Z*DV in accordance with a weighting factor Z, with the corresponding sensor pixel brightness value SV and with the corresponding display pixel brightness value DV, but the present invention is not limited thereto. The blurring pixel brightness value BV may represents a gamma level of a blurring pixel in the blurring pixel set 123, but the present invention is not limited thereto. A minimal distance between the display pixel set 133 and the sensor pixel set 113 is 1, a minimal distance between the blurring pixel set 123 and the sensor pixel set 113 is Z to serve as the weighting factor in this example, and a minimal distance between the blurring pixel set 123 and the display pixel set 133 is (1−Z) along the straight line 102, but the present invention is not limited thereto. When the method of the present invention is implemented, the actual minimal distance between the display pixel set 133 and the sensor pixel set 113 is optional and up to a person of ordinary skill in the art as long as the minimal distance is sufficient for the practice of the present invention. In other words, a CUD-related weighting factor is introduced to determine the blurring pixel brightness value BV, but the present invention is not limited thereto.

Some calculation examples to determine different blurring pixel brightness values BV in accordance with some embodiments of the present invention as shown in FIG. 4 are given as follows. The following calculation examples involve an embodiment of n+m=4, but the present invention is not limited to n+m=4. Any implementation involving n+m≥2 is within the scope and optimizing principles of the present invention.

First Example

FIG. 4 illustrates the sensor pixel set 113 which include a first sensor sub-pixel 114, a second sensor sub-pixel 115, a third sensor sub-pixel 116 and a fourth sensor sub-pixel 117 to form a unit cell 113, regardless the colors of the four sensor sub-pixels. The four sensor sub-pixels are arranged in the unit cell with respect to their specific loci. A locus is referred to as a place where a specific sensor sub-pixel is arranged in a given unit cell along a given straight line, or as a place of interest in the determination of a pixel brightness value, such as a DV or a BV, being performed. For example, the sensor pixel set 113 which includes a first sensor sub-pixel 114, a second sensor sub-pixel 115, a third sensor sub-pixel 116 and a fourth sensor sub-pixel 117 may include four corresponding loci, such as a locus of the first sensor sub-pixel 114, a locus of the second sensor sub-pixel 115, a locus of the third sensor sub-pixel 116 and a locus of the fourth sensor sub-pixel 117, but the present invention is not limited thereto. In the first example, the first sensor sub-pixel 114, the second sensor sub-pixel 115, the third sensor sub-pixel 116 are active sensor pixels and the sensor sub-pixel 117 is an inactive sensor pixel so n=3 and m=1.

Firstly, in accordance with the above principles, the first sensor sub-pixel 114, the second sensor sub-pixel 115 and the third sensor sub-pixel 116 respectively have a maximal sensor pixel brightness value SV (brightness 100) and the sensor sub-pixel 117 has a minimal sensor pixel brightness value 0. The above default condition is simplified as [sub-pixel (corresponding brightness value)]:

[114(100), 115(100), 116(100), 117(0)]

Secondly, FIG. 4 illustrates the display pixel set 133 which includes a first display sub-pixel 134, a second display sub-pixel 135, a third display sub-pixel 136 and a fourth display sub-pixel 137 to form a unit cell 133, regardless the colors of the four display sub-pixels. The four display sub-pixels are arranged in the unit cell with respect to their specific loci. The display pixel brightness values DV of the four display sub-pixels are determined in accordance with DV=[n/(n+m)]*100.

DV134=[3/(3+1)]*100=75 because the first display sub-pixel 134 regionally corresponds to the first sensor sub-pixel 114;

DV135=[3/(3+1)]*100=75 because the second display sub-pixel 135 regionally corresponds to the second sensor sub-pixel 115;

DV136=[3/(3+1)]*100=75 because the third display sub-pixel 136 regionally corresponds to the third sensor sub-pixel 116;

DV137=[3/(3+1)]*100=75 because the fourth display sub-pixel 137 regionally corresponds to the sensor sub-pixel 117.

The above results are simplified as:

[134(75), 135(75), 136(75), 137(75)]

Thirdly, FIG. 4 illustrates the blurring pixel set 123 includes a first blurring sub-pixel 124, a second blurring sub-pixel 125, a third blurring sub-pixel 126 and a fourth blurring sub-pixel 127 to form a unit cell 123, regardless the colors of the four display sub-pixels. The four display sub-pixels are arranged in the unit cell with respect to their specific loci. Supposing Z=0.25, which means that the blurring pixel set 123 is located closer to the sensor pixel set 113, the blurring pixel brightness value BV1 or BV 2 of each display sub-pixel is determined to satisfy the relationship: BV=(1−Z)*SV+Z*DV. The first blurring pixel brightness value BV1 and the second blurring pixel brightness value BV2 may respectively represent a gamma level.

BV124=(1−0.25)*100+0.25*75=93.75 because the first blurring sub-pixel 124 regionally corresponds to the first sensor sub-pixel 114(SV=100);

BV125=(1−0.25)*100+0.25*75=93.75 because the second blurring sub-pixel 125 regionally corresponds to the second sensor sub-pixel 115(SV=100);

BV126=(1−0.25)*100+0.25*75=93.75 because the third blurring sub-pixel 126 regionally corresponds to the third sensor sub-pixel 116(SV=100);

BV127=(1−0.25)*0+0.25*75=18.75 because the fourth blurring sub-pixel 127 regionally corresponds to the sensor sub-pixel 117 (SV=0).

The above adjusted results are simplified as:

[124(93.75), 125(93.75), 126(93.75), 127(18.75)]

Figure 5:
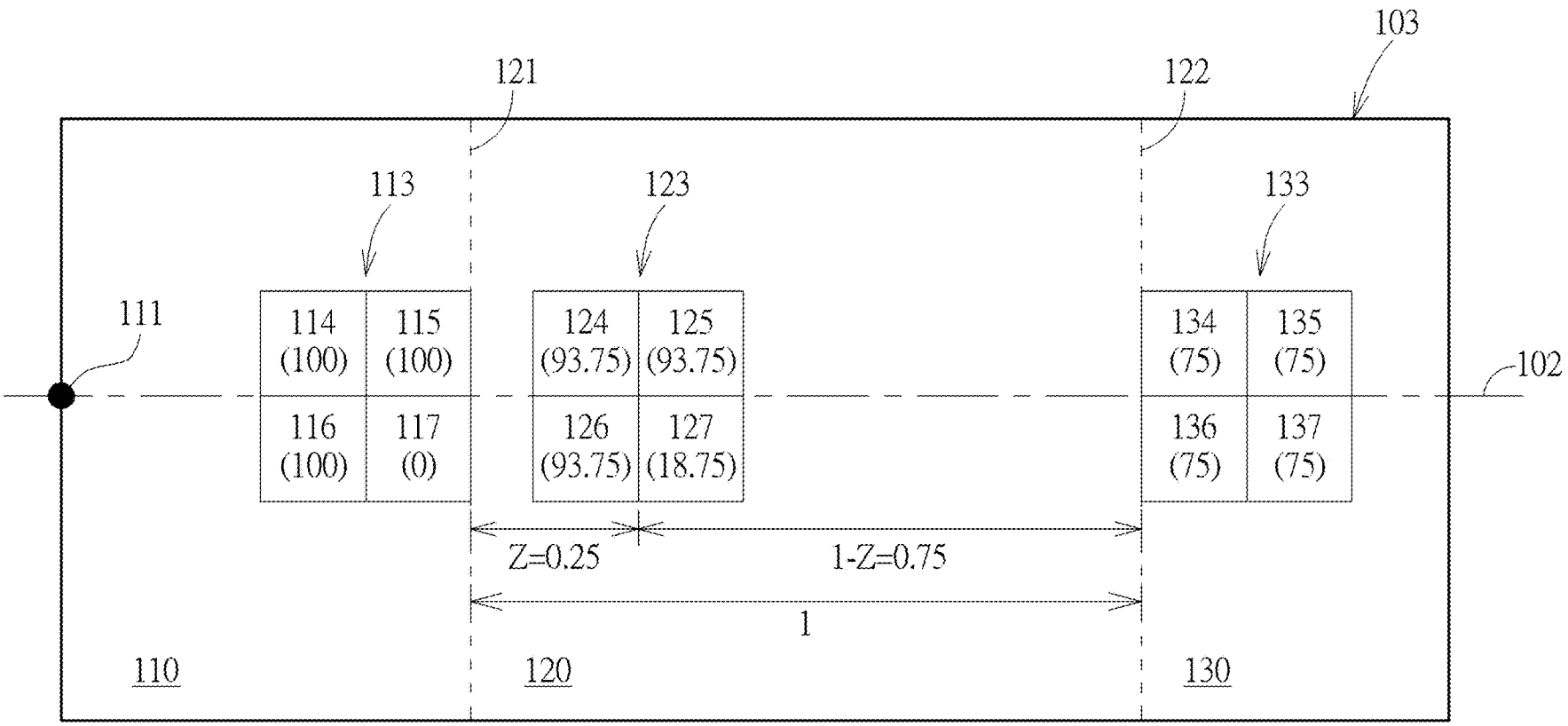
FIG. 5 shows the calculation results in accordance with the first example of the present invention.

The calculation results are shown in FIG. 5.

Please note that the total brightness in each unit cell 113/123/133 is the same (300) to yield uniform visual brightness quality in different pixel sets.

Second Example

FIG. 4 illustrates the sensor pixel set 113 which include a first sensor sub-pixel 114, a second sensor sub-pixel 115, a third sensor sub-pixel 116 and a fourth sensor sub-pixel 117 to form a unit cell 113, regardless the colors of the four sensor sub-pixels. The four sensor sub-pixels are arranged in the unit cell with respect to their specific loci. In the second example, the first sensor sub-pixel 114 and the sensor sub-pixel 117 are active sensor pixels, and the second sensor sub-pixel 115 and the third sensor sub-pixel 116 are the inactive sensor pixels so n=2 and m=2.

Firstly, in accordance with the above principles, the first sensor sub-pixel 114 and the sensor sub-pixel 117 respectively have a maximal sensor pixel brightness value SV (brightness 100), and the second sensor sub-pixel 115 and the third sensor sub-pixel 116 respectively have a minimal sensor pixel brightness value 0. The above default condition is simplified as [sub-pixel (corresponding brightness value)]:

[114(100), 115(0), 116(0), 117(100)]

Secondly, FIG. 4 illustrates the display pixel set 133 which include a first display sub-pixel 134, a second display sub-pixel 135, a third display sub-pixel 136 and a fourth display sub-pixel 137 to form a unit cell 133, regardless the colors of the four display sub-pixels. The four display sub-pixels are arranged in the unit cell with respect to their specific loci. The display pixel brightness values DV of the four display sub-pixels are determined in accordance with DV=[n/(n+m)]*100.

DV134=[2/(2+2)]*100=50 because the first display sub-pixel 134 regionally corresponds to the first sensor sub-pixel 114;

DV135=[2/(2+2)]*100=50 because the second display sub-pixel 135 regionally corresponds to the second sensor sub-pixel 115;

DV136=[2/(2+2)]*100=50 because the third display sub-pixel 136 regionally corresponds to the third sensor sub-pixel 116;

DV137=[2/(2+2)]*100=50 because the fourth display sub-pixel 137 regionally corresponds to the sensor sub-pixel 117.

The above results are simplified as:

[134(50), 135(50), 136(50), 137(50)]

Thirdly, FIG. 4 illustrates the blurring pixel set 123 includes a first blurring sub-pixel 124, a second blurring sub-pixel 125, a third blurring sub-pixel 126, and a fourth blurring sub-pixel 127 to form a unit cell 123, regardless the colors of the four display sub-pixels. The four display sub-pixels are arranged in the unit cell with respect to their specific loci. Supposing Z=0.50, which means that the blurring pixel set 123 is located distantly equal to the sensor pixel set 113 and to the display pixel set 133, the blurring pixel brightness value BV of each display sub-pixel is determined in accordance with BV=(1−Z)*SV+Z*DV.

BV124=(1−0.50)*100+0.50*50=75 because the first blurring sub-pixel 124 regionally corresponds to the first sensor sub-pixel 114(SV=0);

BV125=(1−0.50)*0+0.50*50=25 because the second blurring sub-pixel 125 regionally corresponds to the second sensor sub-pixel 115(SV=100);

BV126=(1−0.50)*0+0.50*50=25 because the third blurring sub-pixel 126 regionally corresponds to the third sensor sub-pixel 116(SV=0);

BV127=(1−0.50)*100+0.50*50=75 because the fourth blurring sub-pixel 127 regionally corresponds to the sensor sub-pixel 117 (SV=100).

The above adjusted results are simplified as:

[124(75), 125(25), 126(25), 127(75)]

Figure 6:
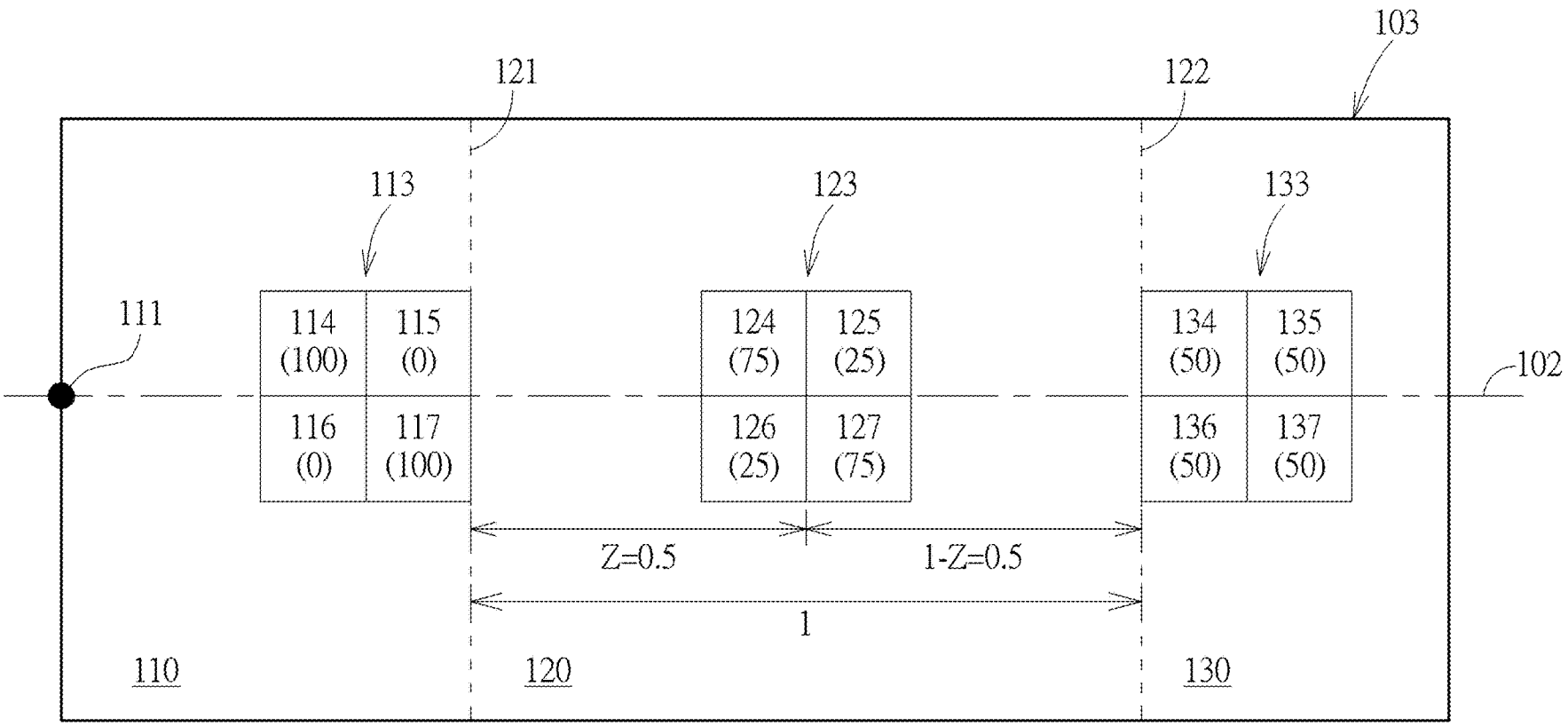
FIG. 6 shows the calculation results in accordance with the second example of the present invention.

The calculation results are shown in FIG. 6.

Please note that the total brightness in each unit cell 113/123/133 is the same (200) to yield uniform visual brightness quality in different pixel sets.

Third Example

FIG. 4 illustrates the sensor pixel set 113 which include a first sensor sub-pixel 114, a second sensor sub-pixel 115, a third sensor sub-pixel 116 and a fourth sensor sub-pixel 117 to form a unit cell 113, regardless the colors of the four sensor sub-pixels. The four sensor sub-pixels are arranged in the unit cell with respect to their specific loci. In the third example, the first sensor sub-pixel 114, the second sensor sub-pixel 115 and the third sensor sub-pixel 116 are inactive sensor pixels, and the fourth sensor sub-pixel 117 is an active sensor pixels so n=1 and m=3.

Firstly, in accordance with the above principles, the first sensor sub-pixel 114, the second sensor sub-pixel 115 and the third sensor sub-pixel 116 respectively have a minimal sensor pixel brightness value 0 and the fourth sensor sub-pixel 117 has a maximal sensor pixel brightness value SV (brightness 100). The above default condition is simplified as [sub-pixel (corresponding brightness value)]:

[114(0), 115(0), 116(0), 117(100)]

Secondly, FIG. 4 illustrates the display pixel set 133 which include a first display sub-pixel 134, a second display sub-pixel 135, a third display sub-pixel 136 and a fourth display sub-pixel 137 to form a unit cell 133, regardless the colors of the four display sub-pixels. The four display sub-pixels are arranged in the unit cell with respect to their specific loci. The display pixel brightness values DV of the four display sub-pixels are determined in accordance with DV=[1/(1+3)]*100.

DV134=[3/(3+1)]*100=25 because the first display sub-pixel 134 regionally corresponds to the first sensor sub-pixel 114;

DV135=[3/(3+1)]*100=25 because the second display sub-pixel 135 regionally corresponds to the second sensor sub-pixel 115;

DV136=[3/(3+1)]*100=25 because the third display sub-pixel 136 regionally corresponds to the third sensor sub-pixel 116;

DV137=[3/(3+1)]*100=25 because the fourth display sub-pixel 137 regionally corresponds to the sensor sub-pixel 117.

The above results are simplified as:

[134(25), 135(25), 136(25), 137(25)]

Thirdly, FIG. 4 illustrates the blurring pixel set 123 includes a first blurring sub-pixel 124, a second blurring sub-pixel 125, a third blurring sub-pixel 126, and a fourth blurring sub-pixel 127 to form a unit cell 123, regardless the colors of the four display sub-pixels. The four display sub-pixels are arranged in the unit cell with respect to their specific loci. Supposing Z=0.75, which means that the blurring pixel set 123 is located closer to the display pixel set 133, the blurring pixel brightness values BV of each display sub-pixel are determined in accordance with BV=(1−Z)*SV+Z*DV.

BV124=(1−0.75)*0+0.75*25=18.75 because the first blurring sub-pixel 124 regionally corresponds to the first sensor sub-pixel 114(SV=0);

BV125=(1−0.75)*0+0.75*25=18.75 because the second blurring sub-pixel 125 regionally corresponds to the second sensor sub-pixel 115(SV=0);

BV126=(1−0.75)*0+0.75*25=18.75 because the third blurring sub-pixel 126 regionally corresponds to the third sensor sub-pixel 116(SV=0);

BV127=(1−0.75)*100+0.75*25=43.75 because the fourth blurring sub-pixel 127 regionally corresponds to the sensor sub-pixel 117 (SV=100).

The above adjusted results are simplified as:

[124(18.75), 125(18.75), 126(18.75), 127(43.75)]

Figure 7:
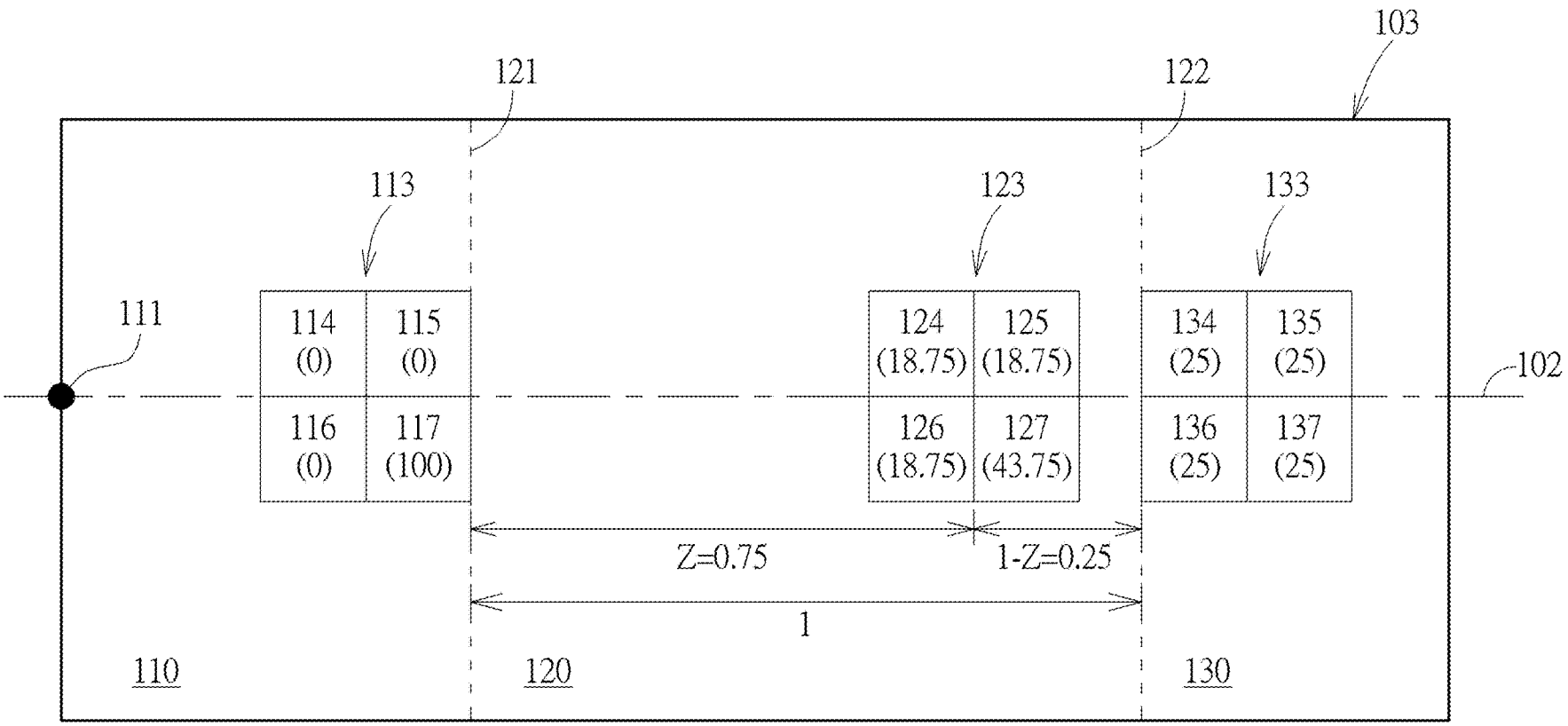
FIG. 7 shows the calculation results in accordance with the third example of the present invention.

The calculation results are shown in FIG. 7.

Please note that the total brightness in each unit cell 113/123/133 is the same (100) to yield uniform visual brightness quality in different pixel sets.

Next, as shown in FIG. 2, the step 50 is carried out after the step 40 is carried. For example, the brightness of each and every pixel unit in the blurring region 120 is determined to obtain a weighted result of every pixel unit in the blurring region 120. The new, weighted results of pixel units in the blurring region 120 may represent a gradient for contour reduction to blur an obvious borderline of a CUD region as shown in FIG. 1. For example, in Example 1 the brightness of some example pixel units in the blurring region 120 is determined to obtain weighted results of the pixel units in the blurring region 120 [124(93.75), 125(93.75), 126(93.75), 127(18.75)]. In Example 2 the brightness of some example pixel units in the blurring region 120 is determined to obtain weighted results of the pixel units in the blurring region 120 [124(75), 125(25), 126(25), 127(75)]. In Example 3 the brightness of some example pixel units in the blurring region 120 is determined to obtain weighted results of the pixel units in the blurring region 120 [124(18.75), 125(18.75), 126(18.75), 127(43.75)].

The weighted results of pixel units are a collection of every weighted result corresponding to every pixel unit in the blurring region 120. For example, the collection in Example 1 is [124(93.75), 125(93.75), 126(93.75), 127(18.75)], the collection in Example 2 is [124(75), 125(25), 126(25), 127(75)], and the collection in Example 3 is [124(18.75), 125(18.75), 126(18.75), 127(43.75)]. Each pixel unit in the blurring region 120 with the weighted result in brightness becomes an adjusted pixel unit which corresponds to the related pixel units in different regions. For example, in Example 1 [114(100)−124(93.75)−134(75)] forms an adjusted first blurring sub-pixel 124 along with the first sensor sub-pixel (CUD) 114 and with the normal first display sub-pixel 134. In Example 2 [115(0)−125(25)−135(50)] forms an adjusted first blurring sub-pixel 124 along with the first sensor sub-pixel (CUD) 114 and with the normal first display sub-pixel 134. In Example 3 [117(100)−127(43.75)−137(25)] forms an adjusted first blurring sub-pixel 124 along with the first sensor sub-pixel (CUD) 114 and with the normal first display sub-pixel 134. An improved brightness gradient is resultantly formed in Example 1, in Example 2 or in Example 3.

After the above steps, as shown in FIG. 2, the step 60 is carried out to output a plurality of adjusted pixel units. Each and every sub-pixel of RGB (referred to as R/G/B information) which is obtained after the above steps in the display panel 101 is output. The R/G/B information may include different information type in terms of brightness and regardless of respective color information. For example, the R/G/B information in the sensor region 110 may involve the original CUD results, such as either the maximal pixel brightness value SV or the minimal pixel brightness value 0. The R/G/B information in the display region 130 may involve a normal result, such as the mean display pixel brightness value DV in accordance with DV=[n/(n+m)]* (maximal pixel brightness value SV). The R/G/B information in the blurring region 120 may involve a collection of gradient results, such as a collection of the blurring pixel brightness values BV in accordance with BV=(1−Z)*SV+Z*DV, in which Z is a variant corresponding to the locus of a given blurring pixel unit.

In particular, a blurring pixel brightness value BV is a weighted result in terms of Z and every weighted result corresponding to every pixel unit in the blurring region 120 is collected and consequently, all weighted results become a collection of brightness information related to all pixel units in the blurring region 120 for outputting a plurality of adjusted pixel units for display purpose.

After the above adjusting method, a novel display device 100 is provided to optimize the visual display quality of a CUD device in the presence of a CUD region, for example to minimize the visual presence of the CUD region. FIG. 3 illustrates a top view of a CUD device in accordance with an example of the present invention. FIG. 4 illustrates a partial enlarged view of the CUD device along the straight line in accordance with FIG. 3 of the present invention. The display device 100 of the present invention includes a display panel 101, an image sensor 112, a sensor pixel set 113, a display pixel set 123 and a blurring pixel set 133.

The display device 100 may be a CUD device. The CUD device may include a display panel 101 for displaying a pictures or images, such as the image 103. The CUD device may further include other suitable elements, such as an input unit (not shown), an output unit (not shown) or a control unit (not shown), but the present invention is not limited thereto.

The display panel 101 may include a plurality of functional regions, for example a sensor region 110, a blurring region 120 and a display region 130, but the present invention is not limited thereto. In some embodiment of the present invention, the sensor region 110 may be enclosed by the blurring region 120, and the blurring region 120 may be enclosed by the display region 130. In some embodiment of the present invention, the blurring region 120 may be in a form of a hollow circle 120H. The hollow circle 120H may include an inner concentric circle 121 and an outer concentric circle 122. The inner concentric circle 121 may have a center 111 of the inner concentric circle 121 so the center 111 may be the center of the outer concentric circle 122, too.

The display panel 101 may include an image sensor 112 disposed in the sensor region 110, and a pixel unit which is occupied by a portion of the image sensor 112 may become a pinhole (a dot) to allow incident light to reach the image sensor 112 to form an image. The image sensor 112 may be at least partially disposed in the sensor region 110 or completely disposed in the sensor region 110. The image sensor 112 may form a plurality of dots and be used as a camera in the sensor region 110 of the CUD device 100. Due to the presence of the one or more pin holes, one or more of the sensor pixel units in the sensor region 110 become one or more inactive sensor pixel units, such as one or more pin holes, because these inactive sensor pixel units are not capable of emitting light any more. FIG. 1 shows the pinholes which correspond to inactive sensor pixel units in the form of a visually dotted region which corresponds to the sensor region 110.

There are a plurality of pixels or sub-pixels in the display device 100. Different pixels or different sub-pixels in different regions of the display device 100 form different pixel sets. In some embodiment of the present invention, a sensor pixel set 113 may be disposed in the sensor region 110 and next to the blurring region 120. In other words, the sensor pixel set 113 may be disposed at the inner concentric circle 121, i.e. a borderline between the sensor region 110 and the blurring region 120. The sensor pixel set 113 may include one or more sensor pixel units.

Accordingly, the sensor region 110 which includes the image sensor 112 may visually shows some active sensor pixels and some inactive sensor pixels. An active sensor pixel may refer to a sensor pixel unit which is capable of emitting light of any suitable color. An inactive sensor pixel may refer to a sensor pixel unit which is not capable of emitting light at all. For example, an inactive sensor pixel may refer to a pixel unit which is occupied by a pin hole, and the pin holes are represented by the image sensor 112 in the sensor region 110 to de-active the functions of the sensor pixel unit. A collection of the inactive sensor pixels in the sensor region 110 may adversely change the predetermined visual presentation of a given image as shown in FIG. 1.

The sensor pixel set 113 may include one or more sensor pixel units to form a unit cell. In one embodiment of the present invention, the active sensor pixels and the inactive sensor pixels in the sensor region 110 may collectively form a pattern or may be regularly arranged. A unit cell which includes the active sensor pixels and the inactive sensor pixels to represent the minimal repeating unit of the pattern or the arrangement is shown by the sensor pixel set 113. For example, a sensor pixel set 113 may include n active sensor pixels and m inactive sensor pixels, wherein n is an integer not less than 1 and m is an integer not less than 1. In another embodiment of the present invention, FIG. 4 illustrates the sensor pixel set 113 may include four sensor sub-pixels so n+m=4, but the present invention is not limited thereto. For example, the sensor pixel set 113 may include a sensor sub-pixel 114, a sensor sub-pixel 115, a sensor sub-pixel 116 and a sensor sub-pixel 117, regardless the colors of the four sensor sub-pixels.

The active sensor pixels in a sensor pixel set 113 may have a maximal sensor pixel brightness value SV. The inactive sensor pixels in a sensor pixel set 113 may have a minimal sensor pixel brightness value 0. A maximal pixel brightness value may refer to a maximal grayscale 255 equivalent to intensity 100%. A minimal pixel brightness value may refer to a minimal grayscale 0 equivalent to intensity 0%. A grayscale or the intensity is well known in the art so the details are not elaborated. In other words, the brightness values of the sensor pixel units may be either SV or 0 so SV may be equal to the brightness value 100.

In some embodiment of the present invention, a display pixel set 133 may be disposed in the display region 130 and next to the blurring region 120. In other words, the display pixel set 133 may be disposed at the outer concentric circle 122, i.e. a borderline between the display region 130 and the blurring region 120. The display pixel set 133 may include one or more display pixel units. FIG. 3 illustrates that each display pixel set 133 may include a plurality of display sub-pixels, but the present invention is not limited thereto.

Similarly, the display pixel set 133 may include one or more display pixel units to form a unit cell. The quantity of display pixel units in a unit cell is the same as that of display pixel units in a unit cell. For example FIG. 4 illustrates the display pixel set 133 may include four display sub-pixels to correspond to the four sensor sub-pixels in the sensor pixel set 113, regardless the colors of the sensor sub-pixels. For example, the display pixel set 133 may include a display sub-pixel 134, a display sub-pixel 135, a display sub-pixel 136 and a display sub-pixel 137, but the present invention is not limited thereto.

If the sensor pixel set 113 includes n active sensor pixels and m inactive sensor pixels, the display pixel brightness value DV of a display pixel unit may be determined to satisfy the relationship: DV=[n/(n+m)]*(maximal pixel brightness value SV). A display pixel brightness value DV which satisfies the above relationship in the display region 130 may ensure the visual brightness uniformity relative to that of the sensor region 110. Accordingly, the display pixel brightness value DV may represent a normal result or a normalized result.

In some embodiment of the present invention, a blurring pixel set 123 may be disposed in the blurring region 120. In other words, the blurring pixel set 123 may be disposed between the inner concentric circle 121 and the outer concentric circle 122, i.e. between the sensor region 110 and the display region 130. The blurring pixel set 123 may include one or more blurring pixel units. FIG. 3 illustrates that each blurring pixel set 123 may include a plurality of sensor sub-pixels, but the present invention is not limited thereto.

Similarly, the blurring pixel set 123 may include one or more blurring pixel units to form a unit cell. The quantity of blurring pixel units in a unit cell is the same as that of sensor pixel units in a unit cell. For example FIG. 4 illustrates the blurring pixel set 123 may include four blurring sub-pixels to correspond to the four sensor sub-pixels in the sensor pixel set 113, regardless the colors of the sensor sub-pixels. For example, the blurring pixel set 123 may include a blurring sub-pixel 124, a blurring sub-pixel 125, a blurring sub-pixel 126, and a blurring sub-pixel 127, but the present invention is not limited thereto.

In some embodiment of the present invention, there may be a straight line 102 passing through the sensor pixel set 113, the blurring pixel set 123 and the display pixel set 133. In some embodiment of the present invention, the straight line 102 may further pass through the center 111 of the inner concentric circle 121, the sensor pixel set 113, the blurring pixel set 123 and the display pixel set 133. In some embodiment of the present invention, FIG. 3 illustrates that a minimal distance between the display pixel set 133 and the sensor pixel set 113 is 1, a minimal distance between the blurring pixel set 123 and the sensor pixel set 113 is Z to serve as a weighting factor, and a minimal distance between the blurring pixel set 123 and the display pixel set 133 is (1−Z) along the straight line 102, but the present invention is not limited thereto. When the method of the present invention is implemented, the actual minimal distance between the display pixel set 133 and the sensor pixel set 113 is optional and up to a person of an ordinary skill in the art as long as the distance is sufficient for the practice of the present invention.

The illumination, for example the brightness of each blurring pixel unit in the blurring region 120 may have a specific blurring pixel brightness value BV in accordance with the display pixel brightness value DV and with the sensor pixel brightness value SV. The blurring pixel brightness value BV may represents a gamma level of a blurring pixel in the blurring pixel set 123, but the present invention is not limited thereto. For instance, a blurring pixel brightness value BV is not greater than the maximal sensor pixel brightness value SV, and not smaller than a corresponding display pixel brightness value DV to satisfy a linear weighting relationship: BV=(1−Z)*SV+Z*DV in accordance with Z, with SV and with DV, but the present invention is not limited thereto.

Consequently, a pixel unit brightness gradient may be formed along the straight line 102 from the sensor pixel set 113 to the display pixel set 133 so that the adverse visual presentation of a given image caused by the inactive display pixels in the sensor region 110 may be gradually weaken and converged to the display region 130 via the blurring region 120. In other words, the pixel unit brightness gradient may be used to blur the obvious borderline 11 of the CUD region 10 as shown in FIG. 1 so that the original borderline 11 may become less visually obvious or further substantially invisible.

A blurring pixel set 123 which forms a unit cell is disposed in the blurring region 120, and located between the sensor pixel set 113 and the display pixel set 133. Each pixel unit in the blurring pixel set 123 has an individual blurring pixel brightness value BV. An individual blurring pixel brightness value BV is calculated to align with a corresponding sensor pixel brightness value SV. A unit cell may include n+m sub-pixels, regardless the colors of sub-pixels, and the n+m sub-pixels may be arranged to form a pattern or arranged in order, for example of locus.

For example, a unit cell in the sensor pixel set 113 may include n active sensor pixels and m inactive sensor pixels, wherein n is an integer not less than 1 and m is an integer not less than 1 so a unit cell may correspondingly include n+m blurring pixels in the blurring pixel set 123 and may correspondingly include n+m display pixels in the display region 130. Some blurring pixel in a unit cell may exclusively correspond to a specific sensor pixel and to a specific display pixel. For example, the first blurring pixel of locus in a unit cell may correspond to the first sensor pixel of locus in another unit cell and to the first display pixel of locus in another unit cell along the straight line 102, and the second blurring pixel of locus in a unit cell may correspond to the second sensor pixel of locus in another unit cell and to the second display pixel of locus in another unit cell along the straight line 102 and so on.

Figure 8:
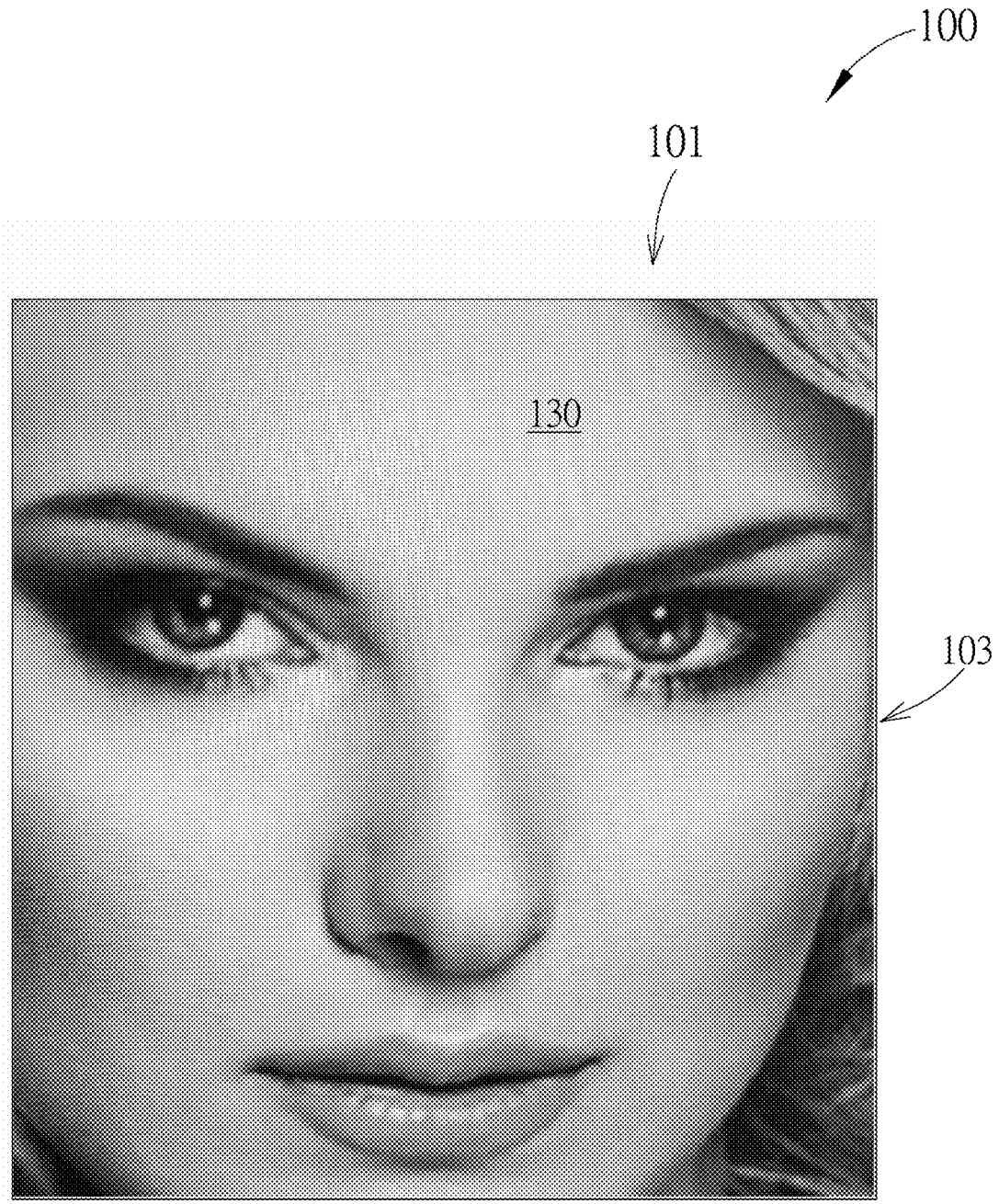
FIG. 8 shows an example of the image which corresponds to the image in FIG. 1 with lessened contour issue occurring on the border of a sensor region (CUD region) and a display region (normal region) after the operations of the method of the present invention to improve the visual display quality of a panel in the presence of the CUD region.

After the step 60, an adjusted image 103 with improved or further optimized visual presentation quality may be resultantly obtained. FIG. 8 shows an example of the image 103 which has the updated R/G/B information with the lessened contour issue in accordance with FIG. 1 after the method of the present invention. As shown in FIG. 8, the image 103 which shows a better visual display quality compared with that in FIG. 1 to minimize the visual presence of the black dots. For example, the image 103 in FIG. 8 has lessened contour issue occurring on the borderline (substantially invisible) between the sensor region (substantially invisible), such as a CUD region, and the display region 130, such as a normal region, after the method of the present invention is carried out on the display panel 101 in the presence of the CUD region.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display device, comprising:

a display panel comprising a display region, a blurring region enclosed by the display region and a sensor region enclosed by the blurring region;

an image sensor disposed in the sensor region;

a sensor pixel set disposed in the sensor region, next to the blurring region and having a maximal sensor pixel brightness value SV, wherein the sensor pixel set comprises n active sensor pixels and m inactive sensor pixels;

a display pixel set disposed in the display region, next to the blurring region and having a display pixel brightness value DV; and a blurring pixel set disposed in the blurring region, located between the sensor pixel set and the display pixel set and having a blurring pixel brightness value BV;

wherein a minimal distance between the display pixel set and the sensor pixel set is 1, a minimal distance between the blurring pixel set and the sensor pixel set is Z and a minimal distance between the blurring pixel set and the display pixel set is (1−Z) so that BV=(1−Z)*SV+Z*DV and DV=[n/(n+m)]*(the maximal pixel brightness value SV, wherein the display pixel set comprises n+m active display pixels and is free of an inactive display pixel.

2. The display device of claim 1, wherein each one of the active display pixels has the display pixel brightness value DV.

3. The display device of claim 1, wherein the blurring region is in a form of a hollow circle and comprises an inner concentric circle and an outer concentric circle, and the inner concentric circle has a center of the inner concentric circle.

4. The display device of claim 3, wherein the blurring pixel set is disposed right between the sensor pixel set and the display pixel set.

5. The display device of claim 1, further comprising:

at least one pin hole disposed in the sensor region.

6. The display device of claim 5, wherein the at least one pin hole represents the m inactive sensor pixels.

7. The display device of claim 1, wherein the blurring pixel brightness value BV represents a gamma level of a blurring pixel in the blurring pixel set.

8. A method to blur a borderline in a CUD device, comprising:

providing a CUD device comprising:

a display region, a blurring region enclosed by the display region and a sensor region enclosed by the blurring region;

a sensor pixel set disposed in the sensor region, next to the blurring region and having a maximal sensor pixel brightness value SV, wherein the sensor pixel set comprises n active sensor pixels and m inactive sensor pixels;

a display pixel set disposed in the display region, next to the blurring region and having a display pixel brightness value DV, wherein the display pixel set comprises n+m active display pixels and is free of an inactive display pixel; and a blurring pixel set disposed in the blurring region, located between the sensor pixel set and the display pixel set, and having a blurring pixel brightness value BV;

determining the display pixel brightness value DV in accordance with DV=[n/(n+m)]*(the maximal pixel brightness value SV); and determining the blurring pixel brightness value BV in accordance with BV=(1−Z)*SV+Z*DV after determining the display pixel brightness value DV, wherein a minimal distance between the display pixel set and the sensor pixel set is 1, a minimal distance between the blurring pixel set and the sensor pixel set is Z, and a minimal distance between the blurring pixel set and the display pixel set is (1−Z).

9. The method to blur a borderline in a CUD device of claim 8, wherein the blurring region is in a form of a hollow circle and comprises an inner concentric circle and an outer concentric circle, and the inner concentric circle has a center of the inner concentric circle.

10. The method to blur a borderline in a CUD device of claim 9, wherein the blurring pixel set is disposed right between the sensor pixel set and the display pixel set.

11. The method to blur a borderline in a CUD device of claim 8, wherein determining the blurring pixel brightness value BV is to blur the borderline of the inner concentric circle.

12. The method to blur a borderline in a CUD device of claim 8, wherein the blurring pixel brightness value BV represents a gamma level of a blurring pixel in the blurring pixel set.

13. The method to blur a borderline in a CUD device of claim 8, wherein the sensor pixel set comprises a first sensor pixel having the maximal sensor pixel brightness value SV and a second sensor pixel having a minimal sensor pixel brightness value 0.

14. The method to blur a borderline in a CUD device of claim 13, wherein the blurring pixel set comprises a first blurring pixel having a first blurring pixel brightness value BV1 and a second blurring pixel having a second blurring pixel brightness value BV2.

15. The method to blur a borderline in a CUD device of claim 14, wherein the first blurring pixel brightness value BV1 is different from the second blurring pixel brightness value BV2.

16. The method to blur a borderline in a CUD device of claim 15, wherein the first blurring pixel brightness value BV1 and the second blurring pixel brightness value BV2 respectively represent a gamma level.

17. The method to blur a borderline in a CUD device of claim 14, wherein the first sensor pixel corresponds to the first blurring pixel and the second sensor pixel corresponds to the second blurring pixel.

18. The method to blur a borderline in a CUD device of claim 8, wherein total brightness of the display pixel set equals to total brightness of the blurring pixel set.

19. The method to blur a borderline in a CUD device of claim 8, wherein total brightness of the sensor pixel set equals to total brightness of the blurring pixel set.

* * * * *